United States Patent [19]

McFarlin

[11] 4,063,204

[45] Dec. 13, 1977

[54] ENERGY ABSORBING AND PRESSURE APPLYING ARRANGEMENT FOR ELECTRICAL CONTACTS

[75] Inventor: William B. McFarlin, Wauwatosa, Wis.

[73] Assignee: Allis-Chalmers Corporation, Milwaukee, Wis.

[21] Appl. No.: 772,766

[22] Filed: Feb. 28, 1977

Related U.S. Application Data

[63] Continuation of Ser. No. 591,281, June 30, 1975, abandoned.

[51] Int. Cl.[2] ..... H01H 3/60

[52] U.S. Cl. ..... 335/193; 200/288; 335/46; 335/104

[58] Field of Search ..... 335/193, 46, 271, 194, 335/104, 247, 248, 157, 158, 156; 200/288, 301

[56] References Cited

U.S. PATENT DOCUMENTS

| | | | |
|---|---|---|---|
| 2,385,994 | 10/1945 | Johnston | 335/193 |
| 2,476,794 | 7/1949 | Austin | 335/194 |
| 2,531,025 | 11/1950 | Bradley | 335/193 |
| 2,932,704 | 4/1960 | Dennison et al. | 335/194 |
| 3,170,054 | 2/1965 | Lawrence et al. | 200/288 |
| 3,217,124 | 11/1965 | Terry | 335/193 |
| 3,284,742 | 11/1966 | Pettit et al. | 335/193 |
| 3,340,376 | 9/1967 | Lundberg | 335/194 |
| 3,550,048 | 12/1970 | Stallman | 335/193 |

*Primary Examiner*—Harold Broome
*Attorney, Agent, or Firm*—Robert C. Sullivan

[57] ABSTRACT

An energy absorbing and contact pressure applying arrangement which minimizes bounce of a movable electrical contact upon engagement with a stationary or fixed electrical contact. In an illustrated embodiment, an armature member is attracted by an electromagnet means to draw the movable contact into engagement with the fixed contact. The movable contact engages the fixed contact before the armature has completed its travel into magnetically sealed engagement with the core of the electromagnet means. During the additional increment of travel necessary for the armature to move into magnetically sealed relation to the core of the electromagnet means, means connected to the moving armature causes compression of an energy absorbing and contact pressure applying device against the carrier arm on which the movable contact is mounted. The energy absorbing and contact pressure applying arrangement may be a composite spring comprising a helical metal wire coil spring embedded in a suitable energy absorbing material such as an elastomeric material, preferably silicone rubber, which dampens the natural resiliency or tendency to bounce of the metal wire spring. The resiliency of the metal wire spring itself is a significant factor in contact bounce. The energy absorbing device greatly reduces, as compared to the prior art, the duration of the time interval during which the movable contact bounces relative to the fixed contact due to the impact of closure, to thereby greatly reduce the duration of arcing and in many instances substantially reducing the amplitude and amount of the arc current between the contacts during the bounce period, with consequent reduction in erosion of the contacts. The reduced duration of the bounce period, in accordance with the present invention, also reduces mechanical wear on the contacts. The advantages of the invention just described result in a substantial increase in contact life. In a modified embodiment which operates upon the same principle as hereinbefore described, movement of the movable contact into engagement with the fixed contact and compression of the energy absorbing device against the movable contact are both imparted by a magnetic plunger which is axially movable in an electromagnetic solenoid.

16 Claims, 17 Drawing Figures

ENERGY ABSORBING AND PRESSURE APPLYING ARRANGEMENT FOR ELECTRICAL CONTACTS

This is a continuation, of application Ser. No. 591,281, filed June 30, 1975, now abandoned.

BACKGROUND OF THE INVENTION

1. Field of the Invention

This invention relates to electrical contact elements which are movable into circuit making and breaking relation with respect to each other and to electrical contactors, relays, switches, or the like embodying such contact elements, and to a composite energy absorbing and contact pressure applying device for use with such contact elements.

2. Description of the Prior Art

In many types of electrical contactors or electrical circuit makers and breakers in commercial use, the movement of the movable contact into engagement with the stationary or fixed contact to close the electrical circuit through the contacts involves an undesirable bouncing action of the movable contact relative to the fixed contact. In most such electrical contactors or circuit makers and breakers a metal biasing spring is used to hold the movable contact under pressure against the fixed contact in the closed position of the contact to reduce contact resistance and consequent $I^2R$ loss through the closed contacts. While the biasing spring which biases the movable contact toward the fixed contact performs an important function once the contacts have finally closed, the resiliency of the biasing springs used in the prior art contribute significantly to undesirable contact bounce during the initial closing period of the contacts.

Bouncing of the movable contact upon closure of the movable contact into engagement with the fixed contact is very undesirable due not only to the mechanical wear which occurs on the contacts due to the contact bouncing, but also due to the damaging effects of the arcing which occurs during the bouncing period. Such arching causing erosion of the contact making surfaces and in extreme cases due to the extremely high temperature of the arc (a cathode spot can reach temperatures of 3500° Kelvin), may cause welding of the movable contact and fixed contact to each other to prevent reopening of the movable contact when desired. Contact welding can cause failure of associated equipment resulting in possible property and personnel damage.

When a typical electrical contactor is used to close the electrical circuit to certain types of electrical loads, the curve of current vs. time may initially rise very steeply from zero to some value such as 2600 amperes, for example, in a very short time interval such as 13 milliseconds, for example. (200 amperes per millisecond.)

If the rate of rise of the magnitude of the electrical current to the load device during the closing operation of the movable contact relative to the fixed contact is some typical value such as 200 amperes per millisecond, it can be seen that if the period during which the movable contact bounces relative to the fixed contact lasts as long as 0.013 second (13 milliseconds) which is a typical condition in accordance with prior art contact devices, then the arc current flow between the bouncing movable contact and the fixed contact will have reached a value such as 2600 amperes by the end of the 13 millisecond interval of contact bouncing. This extremely high arc current during the prolonged period of bounce will accelerate erosion of the mating contacts and will cause possible welding of the contacts as previously explained.

On the other hand, if the period during which bouncing of the movable contact relative to the fixed contact occurs is reduced to a much lower time duration or interval, such as 0.002 second (2 milliseconds), to correspondingly reduce the arcing period between the contacts in accordance with the present invention, as well as reducing the maximum amplitude of arc current reached during the period of bouncing, then it can be seen that erosion of the contacts due to arcing during the closing period, and also the possibility of welding of the movable and fixed contacts to each other can be substantially reduced as compared to the prior art. In addition, the mechanical wear on the contacts due to the impact of bouncing is significantly reduced due to the significant reduction of the duration of the contact bouncing.

It can be said without fear of contradiction that contact life is inversely proportional to contact bounce and contact material loss is directly proportional to contact bounce.

STATEMENT OF THE INVENTION

Accordingly, it is an object of the present invention to provide in conjunction with a pair of electrical contacts which are movable into closed relation with respect to each other, an energy absorbing arrangement for minimizing bouncing of the movable contact relative to the fixed contact upon closure of the two contacts with respect to each other.

It is a further object of the invention to provide in conjunction with a pair of electrical contacts which are movable into closed relation with respect to each other an energy absorbing arrangement which minimizes electrical arcing during the contact closing operation and hence minimizes erosion and wear of the contact surfaces, with resulting increase in contact life.

It is another object of the present invention to provide an electrical device such as an electric switch, an electrical contactor, an electrical relay, or the like, including a pair of electrical contacts which are movable into closed relation with respect to each other, and including a energy absorbing arrangement for minimizing bouncing of the movable contact relative to the fixed contact upon closure of the two contacts with respect to each other.

It is a further object of the invention to provide an electrical device such as an electrical circuit maker and breaker, an electrical switch, an electrical contactor, an electrical relay, or the like, which includes a pair of electrical contacts which are movable into closed relation with respect to each other, and further including an energy absorbing arrangement which minimizes electrical arcing during the contact closing operation and hence minimizes erosion and wear of the contact surfaces, with resulting increase in contact life.

It is another object of the present invention to provide in conjunction with a pair of electrical contacts which are movable into closed relation with respect to each other, an energy absorbing arrangement for minimizing bouncing of the movable contact relative to the fixed contact upon closure of the two contacts with respect to each other, whereby to greatly reduce the duration of the time interval during which bouncing of the movable contact relative to the fixed contact occurs, thereby reducing the duration of and the maximum amplitude reached by the undesiderable arc current during the period of bouncing, as well as significantly reducing the mechanical wear on the contacts due to the significant lessening of the duration of the time period during which contact bouncing occurs.

It is a further object of the invention to provide in conjunction with a pair of electrical contacts which are movable into closed relation with respect to each other an energy absorbing arrangement which substantially reduces the duration of the bounce time of the movable contact relative to the fixed contact during the contact closing period as compared to the prior art devices, to thereby substantially minimize the duration of electrical arcing during the contact closing operation and hence minimize erosion of the contact surfaces with resulting increase in contact life, and additionally substantially minimizing the possibility of welding of the movable and fixed contacts to each other due to arcing, as compared to devices of the prior art.

It is a still further object of the invention to provide an energy absorbing device for absorbing the shock of closing impact of one electrical contact closing into engagement with another electrical contact, whereby to minimize bounce of the movable contact.

It is still a further object of the invention to provide a composite energy absorbing and contact pressure applying device for minimizing bounce of a movable electrical contact upon engagement with a fixed or stationary contact in which the composite device comprises a metal wire spring associated with a suitable energy absorbing material in such manner as to dampen the natural resiliency or tendency to bounce of the metal wire spring, thereby reducing a significant factor in contact bounce.

It is a further object of the invention to provide a composite energy absorbing and contact pressure applying device for minimizing bounce of a movable contact carried by an armature, a plunger or the like actuated to closed position by an electromagnetic core, solenoid or other suitable means which may not be electromagnetic, and in which the substantial elastic hysteresis characteristic of the energy absorbing component of the composit energy absorbing and contact pressure applying device in addition to minimizing contact bounce also facilitates the movement of the armature or the like to its extreme "sealed-in" position.

In achievement of these objectives, there is provided in accordance with embodiments of the invention an energy absorbing and contact pressure applying arrangement for minimizing bounce of a movable electrical contact upon engagement with a stationary or fixed electrical contact. In an illustrated embodiment, an armature member is attracted by an electromagnet means to draw the movable contact into engagement with the fixed contact. The movable contact engages the fixed contact before the armature has completed its travel into magnetically sealed engagement with the core of the electromagnet means. During the additional increment of travel necessary for the armature to move into magnetically sealed relation to the core of the electromagnet means, means connected to the moving armature causes compression of an energy absorbing and contact pressure applying device against the carrier arm on which the movable contact is mounted. The energy absorbing and contact pressure applying device may be a composite spring comprising a helical metal wire coil spring embedded in a suitable shock absorbing material such as an elastomeric material, preferably silicone rubber, which dampens the natural resiliency or tendency to bounce of the metal wire spring, thereby providing a significant factor in reducing contact bounce. The energy absorbing device greatly reduces, as compared to the prior art, the duration of the time interval during which the movable contact bounces relative to the fixed contact due to the impact of closure, to thereby greatly reduce the duration of arcing and in many instances substantially reducing the amplitude and amount of the arc current between the contacts during the bounce period, with consequent reduction in erosion of the contacts. The reduced duration of the bounce period in accordance with the present invention also reduces mechanical wear on the contacts. The advantages of the invention just described result in a substantial increase in contact life. In a modified embodiment which operates upon the same principle as hereinbefore described, movement of the movable contact into engagement with the fixed contact and compression of the energy absorbing device against the movable contact are both imparted by a magnetic plunger which is axially movable in an electromagnetic solenoid.

BRIEF DESCRIPTION OF THE DRAWINGS

Further objects and advantages of the invention will become apparent from the following description taken in conjunction with the accompanying drawings in which.

DESCRIPTION OF THE PREFERRED EMBODIMENTS

Figure 1:
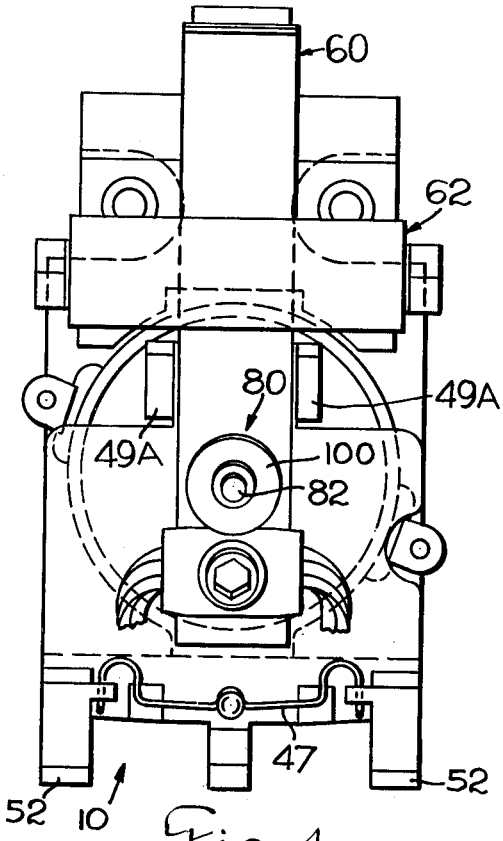
FIG. 1 is a front elevation view of an electrical contactor device embodying the invention.
Figure 2:
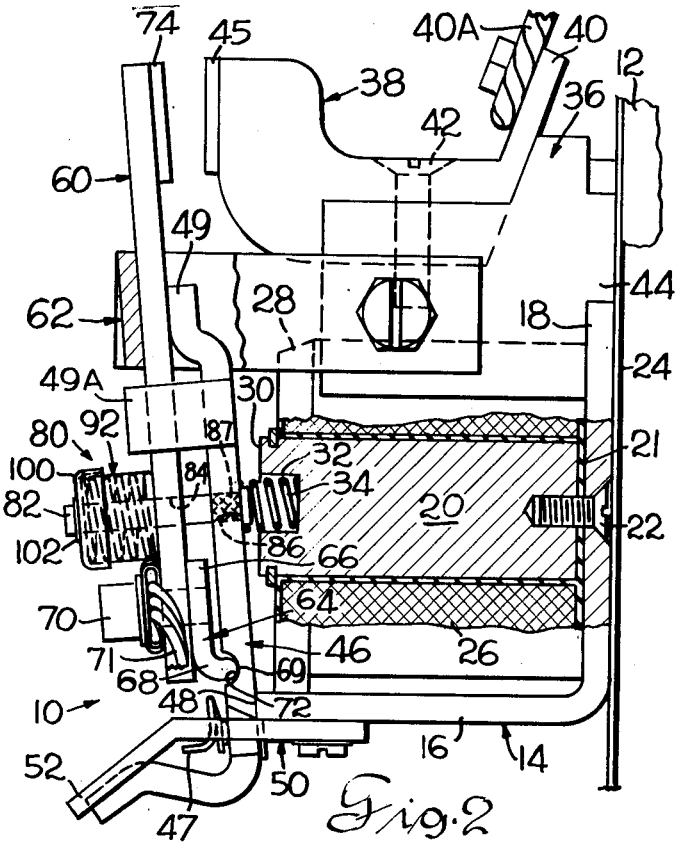
FIG. 2 is a side elevation view partially in section and partially in elevation of the device of FIG. 1 with the contacts being shown in their fully open position as they appear before the electromagnetic operating means of the device has been energized to cause closure of the contacts of the device.

Referring now to the drawings and more particularly to FIGS. 1 and 2, there is shown an electric switch such as a direct current contactor generally indicated at 10 for the purpose of making and breaking a direct current circuit. The illustrated embodiment of the invention is used for making and breaking direct current circuits and hence the term "direct current contactor" will be used in describing the illustrated embodiment, since this is the term used in the art for designating a circuit maker and breaker which interrupts direct current circuits.

While the invention will be described as applied to contactors used in making and breaking a direct current circuit, it will be understood that the invention is equally applicable for use with switching devices used in making and breaking alternating current circuits.

The direct current contactor 10 may have, for example, a steady-state current handling rating of 200 amperes at 36 volts D.C., but may be capable of handling a momentary current inrush upon closing of, for example, 1200 amperes. The contractor 10 may have a current interrupting capacity of, for example, 10 times its normally steady-state current handling rating (i.e., $10 \times 200 = 2000$ amperes). It will be understood, of course, that these values are given merely by way of example and that the principle of the invention does not depend upon the magnitude of the current flow handled by the direct current contactor.

The direct current contactor 10 herein described and illustrated may be used, for example, for opening or closing an electrical circuit on a fork lift truck, and, for example, four such direct current contactors may be used to handle the various direct current circuits on the fork lift truck. Here, again, this is given only by way of example as one type of installation in which the direct current contactor of the illustrated embodiment may be used.

The direct current contactor 10 is normally mounted vertically by suitable screws passing through insulating block 36 (to be described) against a suitable stationary supporting surface 12. The contactor device 10 comprises an L-shaped frame or yoke member generally indicated at 14 formed of a suitable ferromagnetic material, and including a normally horizontally extending base portion or leg 16 and a normally vertically extending leg portion 18. As will be described hereinafter, the L-shaped yoke 14 constitutes part of the electromagnetic actuating circuit of contactor device 10. A cylindrical magnetic core member formed of a material such as low carbon steel and generally indicated at 20 abuts at its right-hand end relative to the view in FIG. 2 against a nonmagnetic spacer 21 which is interposed between cylindrical magnetic core 20 and the left-hand surface of vertical leg 18 of magnetic yoke 14. Nonmagnetic spacer 21 is in effect an air gap in the magnetic circuit between cylindrical magnetic core member 20 and leg 18 of magnetic yoke 14 for the purpose of minimizing residual magnetism in the magnetic structure when electrical winding 26 (to be described) is deenergized. The cylindrical magnetic core member 20 is mechanically secured to magnetic yoke leg 18 by a nonmagnetic stainless steel screw member 22 which also passes through nonmagnetic spacer 21. A sheet 24 of a suitable electrical insulating material is interposed between the facing surfaces of magnetic yoke leg 18, and the supporting surface 12 on which the contactor device 10 is mounted, since yoke member 14 is electrically "hot," and the support surface 12 on which contactor device 10 is mounted is normally of an electrically conducting material; and therefore the interposed sheet 24 of insulating material electrically insulates contactor device 10 and yoke member 14 thereof from the support surface 12 on which device 10 is mounted.

A suitable electrical winding 26 is coaxially positioned about cylindrical magnetic core member 20 and is encapsulated in a suitable insulating material indicated at 28. The cylindrical core 20 projects beyond the encapsulated winding 26 to constitute what in effect is a pole face 30. The left-hand or "pole-face" end of cylindrical magnetic core 20 is provided with an inwardly extending countersunk passage 32 for receiving a return spring 34 which aids in returning to open position the armature and movable contact member carried by the armature, to be hereinafter explained, when the magnetic circuit of contactor device 10 is deenergized.

An insulating block member generally indicated at 36 of plastic or other suitable electrical insulating material which serves as a support for the stationary contact assembly generally indicated at 38 of device 10 is suitably mounted on the upper portion of vertical leg 18 of magnetic yoke 14. A screw (not screw) secures insulating block 36 to yoke leg 18. Insulating block 36 also includes projecting portions 44 which are received in corresponding openings in leg 18 of the magnetic yoke to further securely interlock insulating block 36 to magnetic yoke leg 18.

Stationary contact assembly 38 of a suitable electrical conducting material such as copper is for a portion of its length received in a recess in insulating block 36 and is suitably secured by a screw 42 or the like to insulating block 36. Stationary contact assembly 38 is provided at its righthand end relative to the view in FIG. 2 with a projecting lug 40 by means of which a conductor member 40A leading to the external circuit may be connected by suitable fastening means to stationary assembly 38. At its opposite or left-hand end with respect to the view shown in FIG. 2, stationary contact assembly 38 is provided with a contact indicated at 45 which is formed of a suitably electrically conductive material which may be an alloy comprising, for example, 85 percent silver and 15 percent cadmium oxide. Contact 45 of stationary terminal 38 cooperates with a similar contact 74 to be described on the movable contact arm 60 carried by the pivotally movable armature member 46 to be described.

Contactor device 10 includes an armature generally indicated at 46 which is mounted with substantially a "knife-edge" pivot support on the left-hand end edge 48 of magnetic yoke leg 16. A bracket member generally indicated at 50 having a pair of laterally spaced leg portions 52 which diverge downwardly and to the left of magnetic yoke leg 16 with respect to the view shown in FIG. 2, is rigidly secured to the undersurface of yoke leg 16. A suitable wire spring 47 or the like is rigidly secured to the lower edge of pivotally movable armature 46, with the opposite ends of wire spring 47 being engaged by leg portions 52 of bracket 50 in such manner as to provide a wire spring hinge connection between the lower end of armature 46 and leg portions 52 of bracket contiguous the pivotal edge of armature 46. The spring hinge connection defined by spring 47 between armature 46 and bracket 50 is such that the spring force of spring 47 normally tends to move armature 46 in a counterclockwise direction relative to the views in FIGS. 2, 3 and 4 away from magnetic engagement with magnetic core 20 and in a direction which moves contact 74 on movable contact carrier arm 60 carried by armature 46 to open position relative to fixed stationary contact 45, as will be explained in more detail hereinafter.

In order to limit the counterclockwise opening movement of armature 46 and of the associated movable contact carrier arm 60 associated with armature 46, a U-shaped armature retainer generally indicated at 62 formed of a suitable material such as metal is provided with the free ends of the U-shaped retainer member 62 being suitably secured to the opposite lateral sides of insulating block 36 which supports stationary contact assembly 38. The connecting portion of the U-shaped armature retainer 62 overlies the left-hand or outer surface relative to the views of FIGS. 2, 3 and 4 of movable contact carrier arm 60 to restrain and limit the movement of contact carrier arm 60 and of armature 46 associated therewith in a counterclockwise or opening direction relative to the views of FIGS. 2, 3 and 4.

The movable contact carrier arm generally indicated at 60 is formed of a suitable electrical conductive material such as copper and is pivotally mounted on armature 46 contiguous the lower end of the pivotally movable armature 46 relative to the view of FIG. 2, and contiguous the hinge or pivotal axis of armature 46 relative to leg 16 of magnetic yoke 14. At its upper end movable contact carrier arm 60 carries a contact 74 adapted to engage stationary contact 45. Like contact 45, movable contact 74 may be made of an alloy of silver and cadmium oxide.

In order to pivotally mount movable contact carrier arm 60 relative to armature 46, an L-shaped member generally indicated at 64 is provided and includes one leg 66 thereof in abutting relation to the right-hand surface of the lower end relative to FIG. 2 of movable contact carrier arm 60. L-shaped member 64 is secured to contact carrier arm 60 by means of a screw 70. The same screw 70 is used to clampingly secure conductor lead 71 to movable contact carrier arm 60. The opposite end of conductor lead 71 is secured by a suitable screw or other fastening means (not shown) to magnetic yoke leg 16. A conductor (not shown) leading to the external circuit may be connected to the same fastening means which secures conductor lead 71 to yoke leg 16.

Leg 68 of L-shaped member 64 is provided at its extreme right-hand end relative to the view of FIG. 2 with a suitable pivotal surface or edge 69 which is received in a groove 72 extending part way through the thickness of armature 46. Reception of the pivotal end edge 69 of arm 68 of L-shaped member 64 secured to movable contact carrying arm 60 in groove 72 of armature 46 provides a fulcrum means whereby armature 46 and movable contact carrier arm 60 may move pivotally relative to each other after contact 74 carried by the upper end of contact carrier arm 60 has contactingly engaged the mating surface of stationary contact 45.

Figure 3:
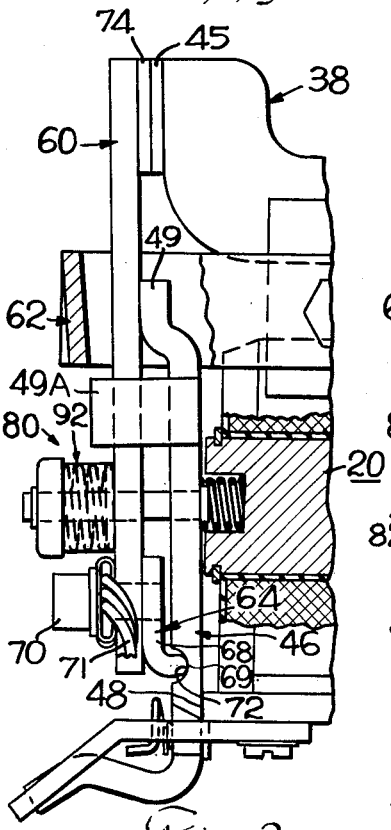
FIG. 3 is a fragmentary view similar to FIG. 2 but showing the parts as they appear when initial contact has been made between the movable contact and the stationary contact, but before the pivotally movable armature member which moves the movable contact has completed its travel to cause further compression of the composite compression spring and energy absorbing material which is a feature of the invention.

Armature 46 is provided contiguous its upper end, with respect to the view shown in FIG. 2 with a pair of laterally spaced outwardly turned arm members each indicated at 49A and respectively lying contiguous but outwardly of the respective opposite lateral edges of movable contact carrier arm 60. Arms 49A serve to orient armature 46 and contact carrier arm 60 relative to each other, particularly during any movement of members 46 and 60 relative to each other. Armature 46 terminates at its upper end relative to the views in the drawing in an outwardly and upwardly turned lip-like portion 49. In the views of FIGS. 2 and 3, the outer or left-hand surface of lip-like portion 49 of armature 46 bears against the facing or right-hand surface of contact carrier arm 60. However, in the view of FIG. 4, in which armature 46 has pulled into magnetic sealing engagement with pole face 30 of magnet core 20, and in which contacts 74 and 45 are engaged, it will be noted that there is a clearance between the facing surfaces of lip-like portion 49 of armature 46 and of contact carrier arm 60. In the FIG. 4 position, as wear occurs upon the contacts 74 and 45, the clearance just described between members 60 and 49 will decrease.

An important feature of the construction is the spring and energy absorbing subassembly generally indicated at 80 which serves to maintain movable contact 74 carried by the movable contact 60 firmly and tightly engaged against the mating surface of the stationary contact 45 during normal steady-state operation of contactor device 10 to reduce contact resistance and $I^2R$ loss between contacts 74 and 45 during steady-state operation of contactor device 10 with contacts 74 and 45 in closed position, the pressure of the movable contact 74 against the stationary contact 45 being maintained despite wear which may occur on the contacts over the operating life of the switch device. The subassembly 80 in accordance with an importance feature of the present invention also serves as a energy absorbing device which minimizes contact bounce of movable contact 74 relative to fixed contact 45 during the contact closing operation with all the various advantages thereof as described in the introductory portion of this specification.

The energy absorber and contact pressure applying assembly generally indicated at 80 comprises a pin member of metal or other suitable material indicated at 82. Pin member 82 extends through a clearance passage 84 in movable contact carrier arm 60, pin 82 projecting to the left beyond the surface of contact carrier arm 60 relative to the view of FIG. 2. Pin 82 also projects beyond the right-hand surface of contact carrier arm 60 relative to FIG. 2 where it engages and passes through a passage 86 in armature 46. Pin 82 is additionally provided with a head portion 88 which bears against the right-hand surface of armature 46 to form a locating device for the restoring spring 34 to be described hereinafter. The portion of pin 82 passing through passage 86 in armature 46 is knurled or upset as indicated at 87 (FIG. 2) in such manner as to provide a tight frictional engagement between pin 82 and armature 46 so that pin 82 is fixed to and travels with armature 46.

Figure 4:
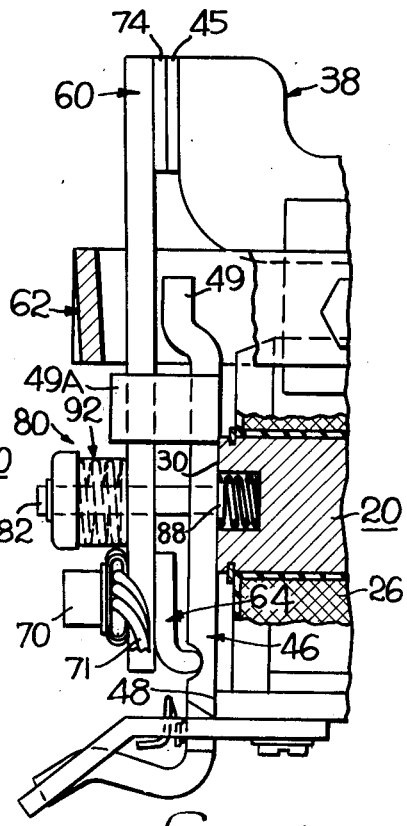
FIG. 4 is a fragmentary view similar to FIG. 3 but showing the relation of the various elements of the device after the movable armature has completed its travel and has "sealed in" against the outer surface of the core of the electromagnetic actuating device for the armature and for the movable contact, this additional "sealing in" movement of the armature causing an additional compression of the composite compression spring and energy absorbing material to apply additional compressive force to hold the movable contact into engagement with the stationary contact.

Coaxially positioned about the end of pin 82 which projects to the left of contact carrier arm 60, relative to the views in FIGS. 2, 3 and 4, and a feature which forms an essential part of the present invention is an energy absorbing and contact pressure applying device generally indicated at 92 which is preferably of cylindrical shape and has an axial passage 94 therethrough for receiving pin 82. Hereinafter in this specification, for simplicity and conciseness of expression, the energy absorbing and contact pressure applying device 92 will sometimes be referred to as "composite spring device 92." However, it will be understood that this term is intended to include a device such as the device generally indicated at 92 in FIGS. 5 and 6 which includes an energy absorbing material to minimize contact bounce and which device 92 also performs the function of maintaining the movable contact, such as movable contact 74, under pressure against the fixed or stationary contact such as 45. Energy absorbing and contact pressure applying device 92 is preferably a composite structure which includes a helically wound resilient metal wire coil spring 96, made of stainless steel wire, metal music wire or the like, which is embedded in a suitable energy absorbing material 98 such as an elastomeric material having energy absorbing characteristics, such energy absorbing material having substantial elastic hysteresis, as will be discussed in more detail hereinafter. The metal wire coil spring 96 helps to provide mechanical reinforcement for the energy absorbing device 92, and also provides spring pressure forcing the movable contact 74 into good contacting engagement with the fixed or stationary contact 45 when contact closure has been completed. The energy absorbing material 98, particularly when compressed in the closed position of the switch also contributes to the pressure applied against the movable contact to hold the movable contact against the stationary contact.

Figure 5:
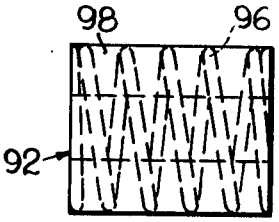
FIG. 5 is an elevation view of the composite compression spring and energy absorbing device shown in FIGS. 1–4, inclusive.
Figure 6:
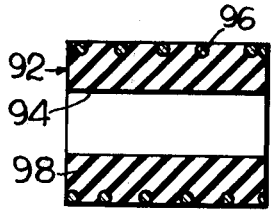
FIG. 6 is a view in vertical section of the device shown in FIG. 5.
Figure 7:
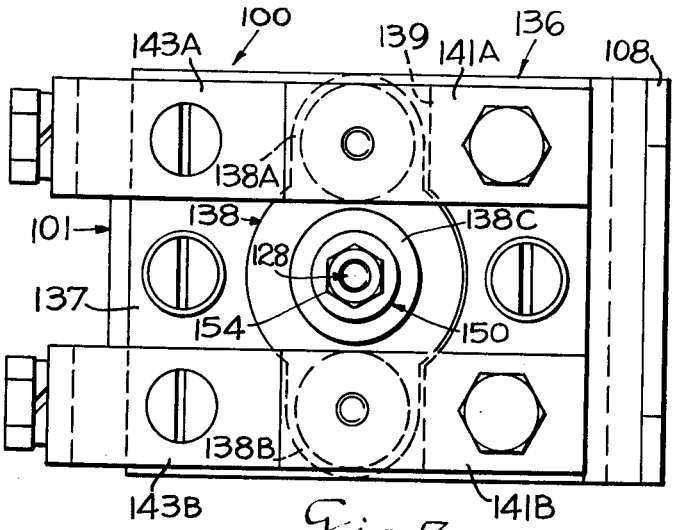
FIG. 7 is a top plan view of a modified electrical contactor utilizing the energy absorbing and contact pressure applying arrangement of the present invention, the switch device of FIG. 7 effecting contact closure by movement of a magnetic plunger in an electromagnetic solenoid.

The energy absorbing material 98 is preferably silicone rubber, which is suitably molded about the coil spring 96, so that coil spring 96 and the molded elastomeric material become one integral body. In the illustrated embodiment, as best seen in FIGS. 5 and 6, the convolutions of the metal wire helical coil spring 96 lie contiguous but embedded in the outer surface of the molded elastomeric material 98. However, coil spring 96 could also be embedded within the molded elastomeric material 98 in such manner as to lie further radially inwardly of the outer periphery of the molded elastomeric material 98 than shown in the embodiment of FIGS. 5 and 6.

Silicone rubber has the following advantageous properties for use as an energy absorbing device: (1) substantial elastic hysteresis which is characterized by good energy absorbing and damping characteristics; (2) stability at high and low temperatures; (3) good weathering resistance; (4) good moisture resistance; (5) good resistance to many chemicals; (6) is a good flame retardant; (7) is resistant to compression set; (8) is resistant to oxidation; and (9) is resistant to deterioration in the presence of ozone and corona which are sometimes present in an electrical environment such as that in which the energy absorbing device of invention might be used in accordance with the illustrated embodiments of the present invention.

A retaining cap member 100 is positioned on the outer or left-hand end relative to the view of FIG. 2 of the composite energy absorbing device 92, and a suitable retaining means such as a cotter pin 102 or the like passes through a passage in the outer or left-hand end of pin 82 to retain cap 100 in overlying covering relation to the outer end of shock absorbing device 92. Preferably, the location of the cotter pin in its retaining relation to spring cap 100 is such as to maintain the composite spring or energy absorbing device 92 under a certain predetermined degree of compression even when the energy absorbing device 92 is in the position shown in FIG. 2 in which magnetic core 20 is unenergized and movable contact 74 is in open relation relative to fixed contact 45. In other words, the energy absorbing device or composite spring 92 is "preloaded" to a predetermined extent even when the contactor assembly 10 is in the open or deenergized position shown in FIG. 2.

To actuate electrical contactor 10 to closed position, electrical coil 26 associated with magnetic core 20 is electrically energized, setting up a magnetic flux in core 20 and magnetic yoke 14 which causes armature 46 to be magnetically attracted toward pole face 30 of magnetic core 20.

As armature 46 moves toward engagement with pole face 30 of magnetic core 20, the armature carries with it movable contact carrier arm 60 to thereby carry movable contact 74 toward stationary contact 45. Movable contact 74 will engage stationary contact 45 as shown in the FIG. 3 position before armature 46 has completed its travel into complete magnetic sealing relation with pole face 30 of magnetic core 20 (the FIG. 4 position). During the travel of armature 46 and movable contact carrier arm 60 from the fully open position of FIG. 2 to the position of FIG. 3 when contact is first made between movable contact 74 and fixed contact 45, the pressure of energy absorbing device or composite spring 92 on the outer or left-hand surface of movable contact arm 60 remains substantially uniform. However, once movable contact 74 and fixed contact 45 have reached their contacting and engaged position shown in FIG. 3 in which no further movement can occur of movable contact 74 relative to fixed contact 45, armature 46 will continue to move inwardly toward magnetically sealed relation with pole face 30 to approach and ultimately arrive at the FIG. 4 position.

Armature 46 can continue to travel relative to contact carrier arm 60 to approach and reach the FIG. 4 position due to the pivotal connection between armature 46 and contact carrier arm 60 provided by fulcrum edge 69 of L-shaped member 64 attached to movable contact arm 60 and pivotally engaging groove 72 in armature 46, as previously described.

Due to the impact with which movable contact 74 engages fixed contact 45 upon closure of contactor 10, there is a tendency of movable contact 74 to bounce away from fixed contact 45, as previously pointed out. In prior art contactor or circuit maker and breaker devices using compression springs of conventional type to press the movable contact into engagement with the fixed contact, this period of bouncing of the movable contact sometimes has a duration of the order of magnitude of 13 milliseconds, for example, during which time interval arcing is occurring between the fixed and movable contacts.

In the illustrated embodiment of FIGS. 1–6, once contact has initially occurred between movable contact 74 and fixed contact 45 during the closing operation of contactor device 10, the relative movement which occurs between armature 46 and movable contact carrier arm 60 as armature 46 approaches the sealed position of FIG. 4 causes pin member 82 which is rigidly fixed relative to armature and which moves with armature 46 to pull inwardly or to the right relative to the view of FIG. 2 upon cap member 100 to thereby additionally compress energy absorbing device or composite spring 92 to thereby apply increased pressure against movable contact carrier arm 60 and the movable contact 74 carried thereby tending to press movable contact 74 into engagement with fixed contact 45. As movable contact 74 bounces off of fixed contact 45 during the initial closing period due to the impact of closure, the bouncing action of contact 45 will be resisted by the energy absorbing characteristics of energy absorbing device or composite spring 92. The fact that the energy absorbing device 92 contains an energy absorbing material such as silicone rubber will absorb the energy of the bouncing contact 74 and will rapidly dampen such bouncing action of movable contact 74.

Due to the energy absorbing characteristics of the energy absorbing device or composite spring 92, I have found that in a typical installation the period of bouncing of movable contact 74 is limited to a period such as 0.002 second (2 milliseconds). In contrast, in a typical installation using only a normal helical metal coil spring of metal music wire or the like and not including the energy absorbing material in accordance with the present invention, the natural resiliency of the helical wire spring will permit a duration of bouncing of a movable contact such as contact 74 for a period of time such as 0.013 second (13 milliseconds).

As pointed out in the introductory portion of this specification, in many electrical circuits in which a device such as the contactor 10 may be used, the rate of current increase upon initial closing of the circuit may be of the order of magnitude of 200 amperes per second. Hence, it can be seen that by reducing the duration of the bounce time of the movable contact to a much shorter interval such as 2 milliseconds as compared to the typical 13 millisecond bounce time interval of prior art devices in such circuits the arc current between a pair of fixed and movable contacts utilizing the energy absorbing device of the present invention does not rise to nearly as high a magnitude during the short bounce interval of the device of the present invention as does the arc current in devices of the prior art which have a relatively much longer contact bounce time. Since the arc current carried between the fixed and movable contacts is much lower in magnitude and of shorter time duration using the device of the present invention as compared to the prior art, the erosion of the contacts utilizing the energy absorbing device of the present invention is greatly reduced, and the possibility of welding of the contacts together due to high arc temperatures is also very greatly reduced as compared to contactor devices using prior art spring biasing means without the energy absorbing characteristics of the present invention. Also, due to the shorter time duration of contact bouncing during the contact closing period, the mechanical wear on the contacts is much less using the energy absorbing device of the present invention than in the prior art arrangements.

It might be pointed out that there are two distinct types of contact bounce between the movable contact 74 and the fixed contact 45 as follows:

1. What might be referred to as "tip" bounce. This is due to the mechanical impact to the movable contact 74 engaging the fixed contact 45. In general, it might be stated that this is the most significant and common type of contact bounce.

2. Reopening of the movable contact 74 due to retravel of the driving member, namely, the armature 46. There is sometimes a tendency of armature 46 to rebound before complete magnetic sealing with pole face 30 occurs, due to the force required to close the contacts. When armature 46 rebounds away from its movement toward magnetic sealing position relative to magnetic core 20, perhaps before having even reached sealing engagement with magnetic core 20, the rebounding of armature 46 will contribute 74 relative to fixed contact 45. However, once armature 46 has actually reached magnetic sealing engagement with pole face 30 of magnetic core member 20, armature 46 tends to remain sealed as long as the electromagnetic winding 26 remains electrically energized.

The "tip" bounce defined in paragraph (1) above is the more significant of the two types of contact bounce. The energy absorbing device or composite spring 92 will dampen both types of contact bounce just described and will significantly reduce the time interval duration of both types of contact bounce as compared to prior art devices.

As will be described hereinafter in more detail, the energy absorbing material 98 of composite spring 92 has substantial elastic hysteresis (see FIG. 12A) which causes the energy absorbing material 98 to absorb energy in each cycle of stress application and release such as one bounce of the movable contact 74 (as represented by the hysteresis loop of FIG. 12A). This energy absorption characteristic of the energy absorbing material 98 not only dampens the bouncing of the movable contact 74 but can be dampening the contact impact energy in the composite spring 92 lessen the force against which the electromagnetic device (core 20) acting on armature 46 must work to move armature 46 into its completely sealed position.

It will be noted from an examination of FIG. 4 that when armature 46 has moved to its sealed position against the pole face 30 of magnetic core member 20 that the return or restoring spring 34 is compressed by the sealing action of armature 46 into the countersunk cavity 32 in the outer end of magnetic core member 20, spring 34 being held under compression while armature 46 is magnetically sealed against pole face 30.

When electromagnetic winding 26 is deenergized to cause the opening of movable contact 74 relative to fixed contact 45, armature 46 and contact carrier arm 60 will be restored to the FIG. 2 position in which contacts 74 and 45 are open with respect to each other, this movement of contactor 10 to open position being effected by the combined effect of (1) the restoring spring 34; (2) the wire spring 47 which is connected between armature 46 and bracket member 50 contiguous the hinge or pivotal axis of armature 46; and (3) composite spring 92.

DESCRIPTION OF MODIFIED EMBODIMENT

Referring now to FIGS. 7 through 11, inclusive, there is shown a modified embodiment of the invention in which the contact pressure applying and energy absorbing device for minimizing contact bounce is used in conjunction with a switch of the type in which the movable contacts are closed into engagement with the fixed contacts by movement of a magnetic plunger movable axially in an electromagnetic solenoid.

Referring now to FIGS. 7 through 11, inclusive, there is shown a solenoid-operated type switch device generally indicated at 100 comprising a magnetic frame generally indicated at 101 which includes a generally U-shaped magnetic yoke member 102 which is seated on and secured to a magnetic base member 104. A metal mounting plate 108 is suitably secured to the normally rearwardly facing leg 110 of U-shaped magnetic yoke 102, whereby to permit attachment of switch device 100 to a suitable mounting surface.

The switch device 100 is normally, although not necessarily, vertically oriented so that the moveable contacts to be described move in a vertical direction in moving from open to closed position, and the winding spool on which the electrical solenoid winding is positioned, to be described, has its axis oriented in a vertical direction.

A winding spool generally indicated at 112 formed of a suitable electrically insulating material is suitably mounted on the upper surface of magnetic base member 104 of magnetic frame 101. Winding spool 112 includes a centrally located axial passage 114 therethrough for receiving an axially movable plunger member 124 of suitable magnetic material, as will be descirbed more fully. The inner diameter of axial passage 114 in the winding spool 112 and the outer diameter of magnetic plunger 124 are such as to provide a close sliding fit of plunger 124 in passage 114.

A pedestal-like member 118 of suitable magnetic material is secured by fastening means to magnetic base member 104 and projects upwardly into the hollow interior of the axial passage 114 of winding spool 112 for about the lower one-third of the height of winding spool 112. Magnetic member 118 is part of the magnetic circuit which also includes magnetic frame 101. The upper surface of upwardly projecting magnetic member 118 is conuntersunk or recessed to define a truncated conical cavity 120 of slightly larger size than the size of mating truncated conical lower end 126 of magnetic plunger 124. Cavity 120 has a substantially flat lower bounding surface 122. Magnetic plunger 124 is provided with a counterbore 125 extending upwardly from the lower end of plunger 124 for a substantial portion of the axial length of plunger 124 to receive a helically wound metal biasing spring 134, the lower end of biasing spring 134 seating on the flat upper surface 122 of upwardly extending magnetic projection 118. A threaded passage 127, of lesser diameter than counterbore 125 extends in magnetic plunger 124 from the upper end of counterbore 125 to the upper end of the plunger, relative to the views in the drawings. The upper end of biasing spring 134 seats on the shoulder defined by the junction of counterbore 125 and threaded passage 127. Biasing spring 134 tends to move magnetic plunger 124 in an upward direction, relative to the views in the drawings to a position in which flange 130 of plunger 124 is elevated above the upper surface 105 of magnetic yoke 102.

A rod member of a suitable nonmagnetic material generally indicated at 128 extends through the entire length of magnetic plunger member 124, rod 128 being in threaded engagement with threaded passage 127 contiguous the upper end of plunger 124. Thus rod 128 is fixed to and movable with magnetic plunger 124. Rod 128 extends through counterbore 125 of magnetic plunger 124, being positioned radially inwardly of biasing spring 134. The upper end of rod 128 extends through and above flange 130 which defines the upper end of and a stop member for magnetic plunger 124, rod 128 cooperating with the movable contact mechanism and with the contact pressure applying and energy absorbing means of the invention in a manner which will be described more fully hereinafter. The lower portion of rod 128 projects through a clearance passage in upwardly extending stationary magnetic member 118 and also passes through and is movable through a close clearance passage in a bearing 119 retained by base member 104 of magnetic frame 101, the motion of the lower end of rod 128 being utilizable if desired to actuate an auxiliary switch or the like, not shown in the illustrated embodiment, and forming no part of the present invention.

Figure 9:
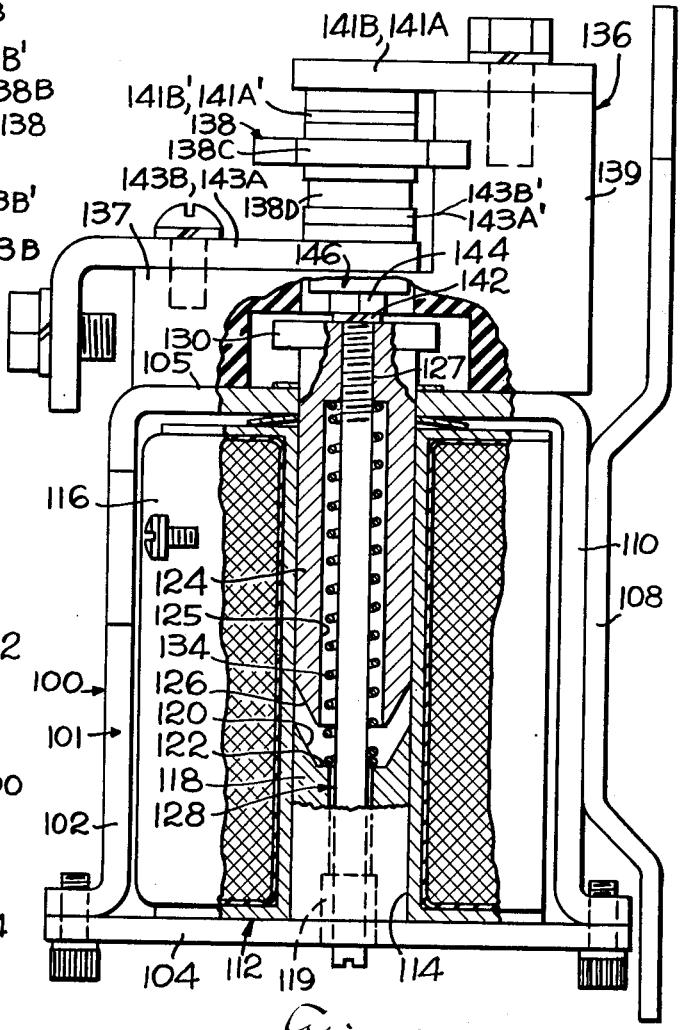
FIG. 9 is a side elevation view of the switch device of FIGS. 7 and 8, and showing the switch in a position in which the electromagnetic solenoid is deenergized.

Mounted on the upper wall 105 of magnetic yoke 102 is a block generally indicated at 136 of suitable insulating material such as a suitable thermoset plastic or the like which supports the stationary contact and terminal structure. Insulating block 136 as viewed in vertical elevation in FIG. 9 is of generally L-shape and includes a horizontal leg 137 and a vertical leg 139. Horizontal leg 137 overlies and is mounted on the upper wall 105 of magnetic yoke 102. Vertical leg 139 of the insulating block 136 has mounted on the upper end thereof a pair of laterally spaced terminal bars or lugs 141A and 141B which respectively carry contacts 141A' and 141B' which are adapted to be bridged by the movable contact structure generally indicated at 138, to be described, when solenoid winding 116 is not energized.

Figure 8:
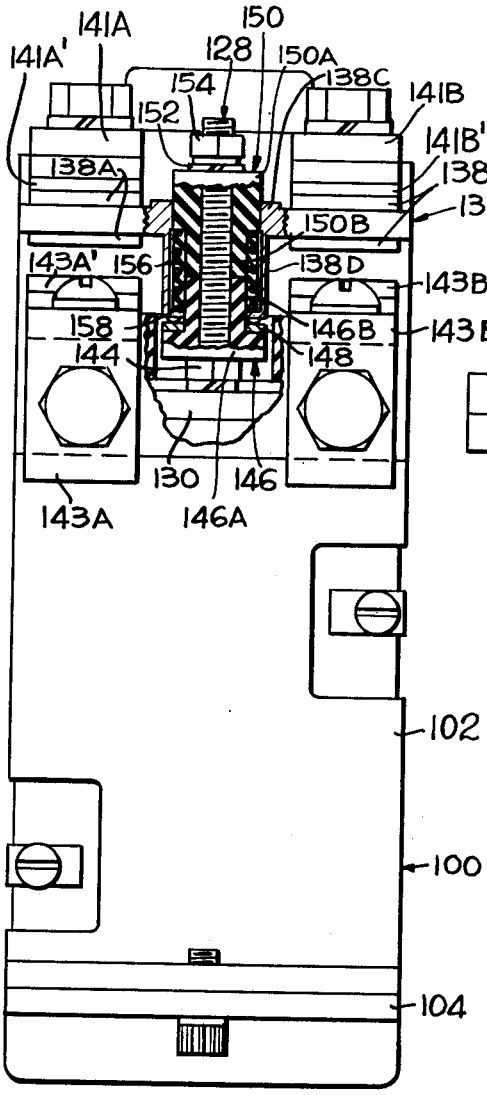
FIG. 8 is a front elevation view of the switch device of FIG. 7.

The stationary contact structure supported by insulating block 136 also includes a lower pair of laterally spaced terminal bars or lugs respectively indicated at 143A and 143B mounted on horizontal leg 137 of insulating block 136 and respectively carrying at the right-hand end thereof with respect to the view shown in FIGS. 8 and 9 the fixed contacts 143A' and 143B' which are respectively in vertical axial alignment with the resepctive upper stationary contacts 141A' and 141B'. As will be explained more fully, the movable contact structure generally indicated at 138 is adapted to engage the upper stationary contacts 141A' and 141B' in bridging relation when electromagnetic solenoid 116 is deenergized, since the force of biasing spring 134 forces magnetic plunger 124 upwardly to cause the movable contact structure 138 to bridge the upper stationary contacts 141A' and 141B'. Also, as will be explained more fully, when the electromagnetic solenoid or winding 116 is energized, magnetic plunger 124 is pulled in a downward direction against the biasing force of spring 134 and in so doing imparts a downward movement to movable contact structure 138 to cause movable contact structure 138 to bridge the lower stationary contacts 143A' and 143B'.

The movable contact structure generally indicated at 138 includes a pair of laterally spaced contacts 138A and 138B connected together by an electrically conducting connecting portion 138C. Each of the respective contacts indicated at 138A and 138B respectively includes a separate contact element or conact surface adapted to engage a corresponding upper or lower contact 141A', 141B', or 143A', 143B'. The movable contact structure 138 also includes a hollow cylindrical cup-like member 138D which extends downwardly from a centrally located portion of connecting portion 138C.

The subassembly which is mounted on rod member 128 and projects above flange portion 130 of magnetic plunger 124 and which includes the movable contact structure generally indicated at 138 together with the composite spring energy absorbing device which cooperates with movable contact structure 138 will now be described.

It will be understood that horizontal leg 137 of insulating block 136 is suitably apertured to accommodate any necessary vertical movement of magnetic plunger 124 and flange 130 of plunger 124 and of rod 128 which is fixed to magnetic plunger 124 and of elements carried by rod 128 which move into insulating block 136 during the vertical travel of plunger 124 and rod 128. It will also be understood that upper wall 105 of magnetic yoke 102 is suitably apertured to accommodate vertical movement of magnetic plunger 124.

A washer member 142 is seated on and in contact with the upper surface of plunger flange member 130, being coaxially positioned about rod 128. A nut member 144 is tightened in threaded engagement with rod 128 immediately above washer 142.

Coaxially positioned about rod 128 above nut member 144 is a lower T-shaped insulator member generally indicated at 146 having an axial passage therethrough to receive rod 128. T-shaped insulator member 146 includes a flange-like head portion 146A which seats on the upper surface of nut member 144, and an upwardly extending hollow stem portion 146B. A washer 148 which is coaxially positioned about stem portion 146B seats on the upper surface of head portion 146A of the T-shaped insulator 146. When solenoid winding 116 is not energized, the lower edge of the hollow cylindrical cup-like portion 138D of the movable contact structure 138 seats on the upper surface of washer 148. The stem portion 146B of the T-shaped insulator member 146 extends upwardly into a hollow passage of the downwardly extending hollow cylindrical cup-like member 138D which is carried by the connecting portion 138C of movable contact structure or subassembly 138.

A second and upper T-shaped insulator 150 is coaxially positioned about the upper portion of rod 128 and includes a flange-like head portion 150A and a downwardly extending hollow stem portion 150B. A washer 152 is positioned above the upper surface of head portion 150A of upper T-shaped insulator member 150 and a nut member 154 is tightened into threaded engagement with the threaded upper end of rod 128.

The stem portion 150B of the upper T-shaped insulator member extends downwardly into the open upper end of the hollow cylindrical cup-like portion 138D carried by the movable contact subassembly 138. When the assembly of the lower and upper T-shaped insulator members 146 and 150, respectively, is tightened onto plunger rod 128 by tightening the upper nut 154 onto the threaded portion of rod 128, the lower end of upper stem portion 150B is in face-to-face abutting contact with the upper end of the lower stem portion 146B. The lower nut 144 was tightened prior to tightening nut 154.

A contact pressure applying and energy absorbing device 156 of the type previously described in connection with the embodiment of FIGS. 1–6, inclusive and shown in detail in FIGS. 5 and 6 is positioned in cup-like portion 138D of movable contact subassembly 138 in generally coaxial relation to stem portions 146B and 150B of the respective T-shaped insulator members 146 and 150. The upper end of contact pressure applying and energy absorbing device 156 bears against the shoulder defined by the junction of head portion 150A and stem portion 150B of upper T-shaped insulator member 150, while the lower end of contact pressure applying and energy absorber device 156 seats upon a radially inwardly turned flange 158 at the lower end of hollow cylindrical cup-like portion 138D which forms part of the movable contact subassembly.

DESCRIPTION OF OPERATION OF THE MODIFIED EMBODIMENT

Figure 10:
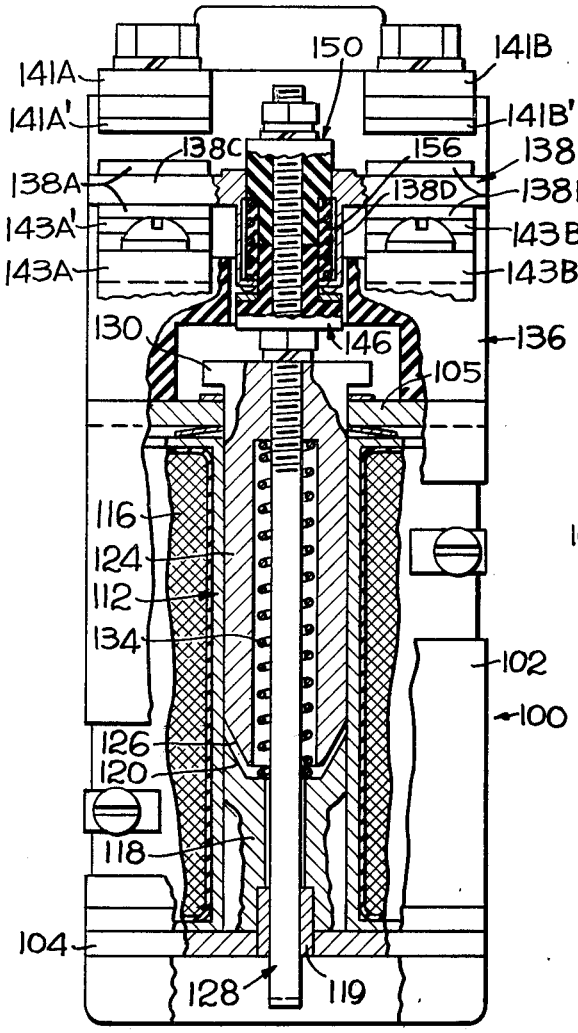
FIG. 10 is a view of the switch device of FIGS. 7 through 9, inclusive, with the electromagnetic solenoid energized and with the movable contacts just making engagement with the cooperating fixed contacts.
Figure 11:
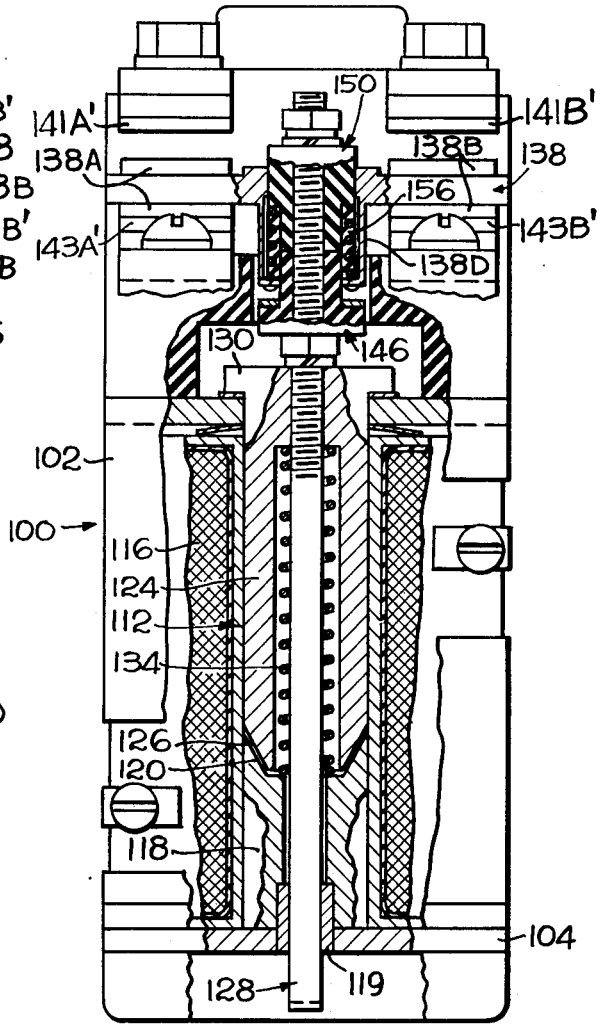
FIG. 11 is a view of the switch device of FIGS. 7 through 10, inclusive, with the solenoid energized and in which the movable magnetic plunger has completed its axial movement within the solenoid to additionally compress the energy absorbing and contact pressure applying device of the invention for applying additional pressure on the movable contacts relative to the fixed contacts.

When solenoid 116 is not energized, magnetic plunger 124 and rod member 128 secured thereto will move upwardly under the influence of biasing spring 134, to thereby move the movable contact subassembly 138 to the position shown in FIGS. 8 and 9 in which upper stationary contacts 141A' and 141B' are bridged by the movable contact structure 138 to complete the electrical circuit in which contacts 141A' and 141B' are connected.

when solenoid winding 116 is energized, magnetic plunger 124 and rod 128 attached thereto are drawn downwardly relative to the views in the drawings to first approach the position shown in FIG. 10. Downward movement of magnetic plunger 124 and rod 128 is communicated to movable contact subassembly 138 through the engagement of head portion 150 of T-shaped insulator member with the upper end of contact pressure applying and energy absorber device 156. The downward movement of magnetic plunger 124 and of the attached rod member 128 will move the movable contact subassembly 138 downwardly to reach the position shown in FIG. 10 in which the contacts 138A and 138B carried by movable contact subassembly 138 make bridging engagement with the lower stationary contacts 143A' and 143B' to complete an electrical circuit through stationary contacts 143A' and 143B'. When the movable contact subassembly 138 thus engages the lower stationary contacts 143A' and 143B', no further downward movement of the movable contact structure or subassembly 138 can occur; however, when this point is reached the magnetic plunger 124 still has not yet completed its downward travel and still has a further increment of downward travel. The further increment of downward travel of magnetic plunger 124 is terminated when the plunger 124 reaches the FIG. 11 position in which flange 130 at the upper end of plunger 124 abuts against the upper surface of the top wall 105 of magnetic yoke 102. When this happens the magnetic plunger 124 cannot move any further in a downward direction.

During the aforementioned additional increment of movement of magnetic plunger 124 which occurs after movable contact subassembly 138 has moved into abutting relation to the lower fixed contacts 143A' and 143B', the additional increment of downward movement of magnetic plunger 124 and of rod 128 connected to plunger 124 causes head portion 150A of upper T-shaped insulator member 150 to move downwardly in hollow cylindrical cup-like portion 138D of movable contact subassembly 138 to compress downwardly on composite spring or contact pressure applying and energy absorber device 156, thereby storing additional energy in composite spring device 156 which aids in maintaining good contact pressure when contact closure has been finally completed. The energy absorbing component of the composite spring, such as silicone rubber, serves to dampen bouncing movement of the movable contact structure 138 and the contacts carried thereby relative to the lower stationary contact elements 143A' and 143B', in the same manner as described in connection with the embodiment of FIGS. 1–6 inclusive.

As previously mentioned, the energy absorbing material 98 of FIGS. 5 and 6 is preferably silicone rubber. A particular silicone rubber which has been found suitable for this purpose is in accordance with American Society of Testing Materials (ASTM) standard D2,000, subspecifications 4 GE 307A19 & B37. This silicone rubber has the following properties:

1. Hardness: durometer 35 ± 5
2. Tensile strength: 700 pounds per square inch
3. Elongation: 500 percent
4. Tear strength: 55 pounds per inch Silicon rubber is also characterized by the fact that it is an energy absorbing means having substantial elastic hysteresis which is characterized by a substantial damping effect providing a substantial reduction in contact bounce when incorporated in the composite spring device 92 (FIGS. 1–6, inclusive) or 156 (FIGS. 7–11, inclusive).

Figure 12A:
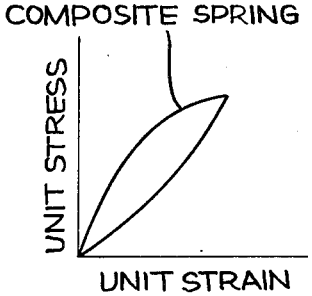
FIG. 12A is a curve showing the hysteresis loop for a composite spring in accordance with the invention such as that shown in FIGS. 5 and 6 which incorporate a damping material such as silicone rubber having substantial elastic hysteresis, which is characterized by a substantial damping effect to thereby minimize contact bounce, as indicated by the relatively large area within the hysteresis loop.

Thus, as seen in FIG. 12A, the hysteresis loop which represents one cycle of application of stress and of relief of stree (for example, one bounce of the movable electrical contact) to the composite spring 92 or 156 which embodies energy absorbing material having substantial elastic hysteresis (such as silicone rubber), it will be noted that on a given cycle of application of stress and of relief of stress to the composite spring, more energy is imparted to the composite spring during the application of stress during the given cycle than is returned by the composite spring during the relief of the stress, this difference between the energy imparted to the composite spring and the energy returned by the composite spring during the given cycle being represented by the substantial area inside the hysteresis loop, indicative of the substantial damping effect provided by the composite spring 92 or 156. The energy absorbed by the composite spring may be dissipated in the form of molecular heat of the energy absorbing component of the composite spring, such as the silicone rubber 98.

Figure 12B:
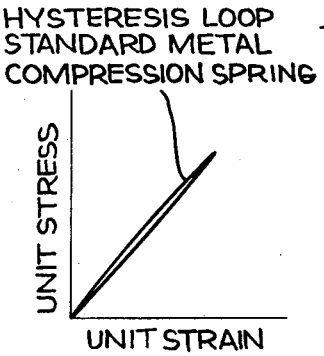
FIG. 12B is a curve showing the hysteresis loop for a metal compression spring in accordance with the prior art, with the almost negligible area within the hysteresis loop being indicative of the almost negligible damping effect of the metal compression spring of the prior art.

In contrast, from an examination of FIG. 12B which shows the hysteresis loop for one cycle of application of stress and of relief of stress of a prior art metal spring which does not incorporate the energy absorbing material in accordance with the invention, it can be seen that the area inside the hysteresis loop is negligible, which indicates that the prior art metal spring without the energy absorbing material provides negligible damping effect on the bouncing contact.

For a discussion of the phenomenon of hysteresis or damping, reference is made to the publication "Handbook of Engineering Fundamentals" by Ovid W. Eshbach, Wiley & Sons, New York and London, 8th printing, January, 1961, Section 5–11.

For a discussion of the low elastic hysteresis or low damping of conventional metal springs, reference is made to the following two publications: (1) "Handbook of Mechanical Spring Design" by Associated Spring Corporation, Bristol, Connecticut, copyright 1956 and (2) "Design Handbook, " by Associated Spring Corporation, Bristol, Connecticut, copyright 1967.

While silicone rubber has been found to perform very satisfactorily under test conditions as an energy absorbing material as described hereinbefore in this specification, other materials may be used in place of silicone rubber as the energy absorbing material including the following materials:

1. Rubber
2. Rubber-like plastics
3. Neoprene rubber
4. Latex foam rubbers
5. Sponge and cellular rubbers
6. Synthetic rubber
7. Butyl rubber
8. Urethane foam
9. Closed Cell Polyvinyl Chloride Silicone rubber having the properties just described can be obtained in a composite spring molded structure such as that shown in FIGS. 5 and 6 of the present application and in accordance with engineering specifications provided by applicant from Moxness Products, Inc. 1914 Indiana Street, Racine, Wisconsin, 53405, the silicone rubber content thereof being identified as Moxness part No. MS 30 GO 5.

The preferred from of the invention has been illustrated using a contact pressure applying and energy absorbing device as shown in FIGS. 5 and 6 in which a helically wound metal coil spring is embedded in an energy absorbing material such as silicone rubber or other suitable energy absorbing material. It is also within the scope of the present invention to eliminate from the composite structure the metal wire spring 96 and use as a contact pressure applying and energy absorbing device 92 in the embodiment of FIGS. 1–6 or as an equivalent contact pressure applying and energy absorbing device 156 in the embodiment of FIGS. 7–11, a contact pressure applying and energy absorbing device which does not utilize the helically wound metal wire spring and utilizes only the energy absorbing material, preferably silicone rubber, or some other material previously listed which could be used in place of the silicone rubber as the energy absorbing material.

In determining the size and characteristics of the energy absorbing device such as 92 or 156 for use with a switch device it is important to match the energy absorbing qualities of the energy absorbing device with the impact load that is involved in the particular switch with which the energy absorbing device is being used. Maximum effect or lowest possible contact bounce involves "tuning the system," i.e. — using the proper energy absorbing composite spring or energy absorbing device 92 or 156 with the impact which is present in the given situation.

Everything that moves possesses kinetic energy. When it becomes necessary to stop a moving object a means must be found to dissipate this kinetic energy. In the case of the switch device shown in the views of the embodiment shown in FIGS. 1—4, inclusive, for example, the kinetic energy of the movable contact assembly mass, including contact carrier arm 60 and contact 74 carried by the armature 46 is controlled significantly when the contact assembly impacts against the stationary contact. This is accomplished by converting the kinetic energy of the movable contact assembly mass into molecular heat and deflection principally of the silicone rubber energy absorbing or other energy absorbing material 98 and to a much lesser extent of metal compression spring 96 (FIGS. 5 and 6). The silicone rubber 98 in contrast to the metal compression spring 96 is slow to react to sudden applied forces which results in an energy absorbing assembly which reduces contact bounce.

Factors which are involved in designing the proper energy absorbing composite spring 92 (FIGS. 5 and 6) for a given contact impact include the following:

1. velocity of the movable contact upon impact;
2. maximum shock force that the surrounding structure or the load can withstand;
3. the cyclic frequency to which the composite spring or energy absorbing device 92 is subjected;
4. the environmental conditions to which the composite spring or energy absorbing device 92 is exposed.

Resilience is the strain energy which may be recovered from a deformed body when the load causing the stress is removed. Within the proportional limit, the resilience is equal to the external work performed in deforming a bar of material and can be determined by the following equation:

$$\omega = \frac{1}{2}\left(\frac{\sigma^2}{E}\right)AL$$

in which $\delta$ = unit stress in pounds per square inch
E = modulus of elasticity
A = cross-sectional area in square inches
L = length of material.

When $\delta$ is equal to the proportional limit, the factor $$\frac{1}{2}\left(\frac{\sigma^2}{E}\right)$$

is the modulus of resilience. This is the measure of capacity of a unit volume of material to store strain energy up to the proportional limit.

When a compression load is applied to the composite spring or energy absorber device 92, (FIGS. 5 and 6) the composite spring does not produce the complete compression immediately but there is a definite time lapse which depends on the nature of the materials and the magnitude of the stresses involved. In the same manner, upon unloading of the energy absorbing device complete recovery of energy does not occur, as previously explained. This phenomenon is termed "elastic hysteresis" or damping. The area of the hysteresis loop (FIG. 12A) for a composite spring 92 or 156 represents the energy dissipated per cycle (in the form of heat) and is a measure of the damping properties of the energy absorbing device. Under vibratory conditions, the energy dissipated varies approximately as the cube of the stress. There is little or no hysteresis in and consequently little or no energy loss or dampening effect in properly designed extension, compression or open wound metal torsion springs such as the helically wound metal coil spring 96 shown in FIGS. 5 and 6. (See FIG. 12B.) Hysteresis is shown by the deviation between loading and unloading curves of a spring. Internal friction in a metal coil spring of the type such as that shown at 96 in FIGS. 5 and 6 account for almost no energy loss. However, there is substantial elastic hysteresis in the energy absorbing material 98 of FIGS. 5 and 6, resulting in a substantial damping effect.

It has been found that the dynamic properties of a energy absorbing material composition such as that used in a composite spring 92 of FIGS. 5 and 6 are dependent on volume, velocity of the applied load and material condition. If the velocity of the applied load is kept within certain limiting values the total energy value for static and dynamic conditions are identical.

While the composite spring 92 of FIGS. 5 and 6 has been shown and described as comprising a metal wire spring 96 molded in or otherwise embedded in the energy absorbing material 98 such as silicone rubber, it is also within the scope of the invention to form the energy absorbing material, such as silicone rubber (1) as a separate tubing fitting inside the metal spring; or (2) as a separate tubing fitting outside the metal spring.

Figure 13A:
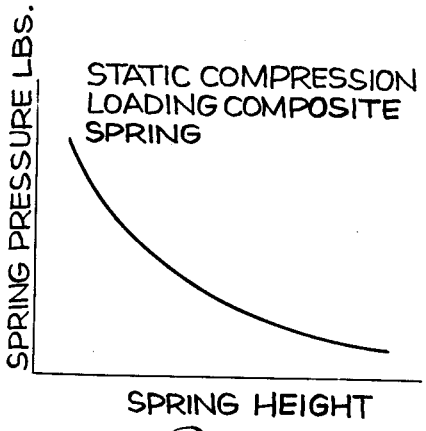
FIG. 13A is a curve showing the static loading characteristic of a composite spring in accordance with the invention, with spring pressure in pounds being plotted as an ordinate vs. spring height as an abscissa.
Figure 13B:
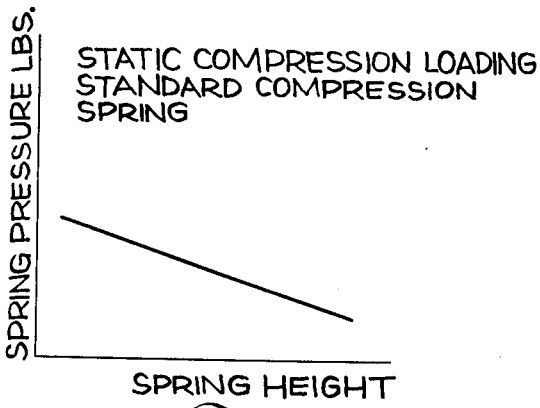
FIG. 13B is a curve showing the static loading characteristic of a standard metal compression spring with spring pressure in pounds being plotted as an ordinate vs. spring height as an abscissa.

Refer to the comparative curves shown in FIGS. 13A and 13B which compare the static loading characteristics of a composite spring in accordance with applicant's invention (FIG. 13A) with the static loading characteristic of a standard metal compression spring (FIG. 13B). It will be noted in FIG. 13A that when spring pressure in pounds is plotted as an ordinate vs. spring height as an abscissa for applicant's composite spring an inverse curvilinear or inverse exponential curve results; while in FIG. 13B when spring pressure is plotted against spring height for a standard metal compression spring, an inverse linear curve results.

Figure 14:
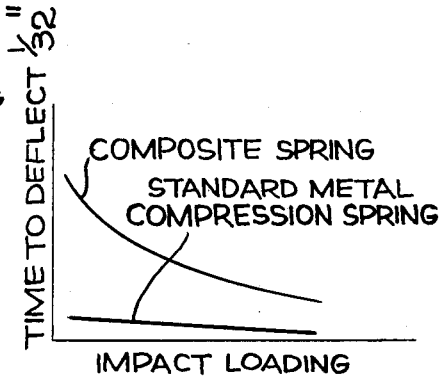
FIG. 14 is a graph showing for comparison the impact loading characteristic of a composite spring in accordance with the invention as compared to a standard metal compression spring, with time required for the spring to deflect a predetermined distance such as 1/32 inch, being plotted in each case vs. impact loading in pounds.

Refer now to the curves of FIG. 14 in which the impact loading characteristic of applicant's composite spring is compared with the impact loading characteristic of a standard metal compression spring. In both curves of FIG. 14 the time required for the given spring to deflect a predetermined distance (such as 1/32 inch, for example) is plotted as an ordinate against the impact loading on the spring in pounds as an abscissa. It will be noted that the impact loading characteristic curve for applicant's composite spring is of inverse exponential or inverse curvilinear shape; whereas the corresponding curve for the standard metal compression spring is of inverse linear shape. Furthermore, as indicated by the curve for applicant's composite spring in FIG. 14 the time required for applicant's composite spring to deflect the predetermined distance (such as 1/32 inch) is substantially greater for all values of impact loading than the time required for the standard metal compression spring to deflect the same distance. The two curves of FIG. 14, taken together, show that the reaction to applied impact loading is substantially slower for applicant's composite spring than for the standard metal compression spring. It is this delayed reaction characteristic of applicant's composite spring as brought out in FIG. 14 and the phenonomenon of elastic hysteresis, previously described which are responsible for the damping effect and substantial reduction in contact bounce, previously described.

Figure 15:
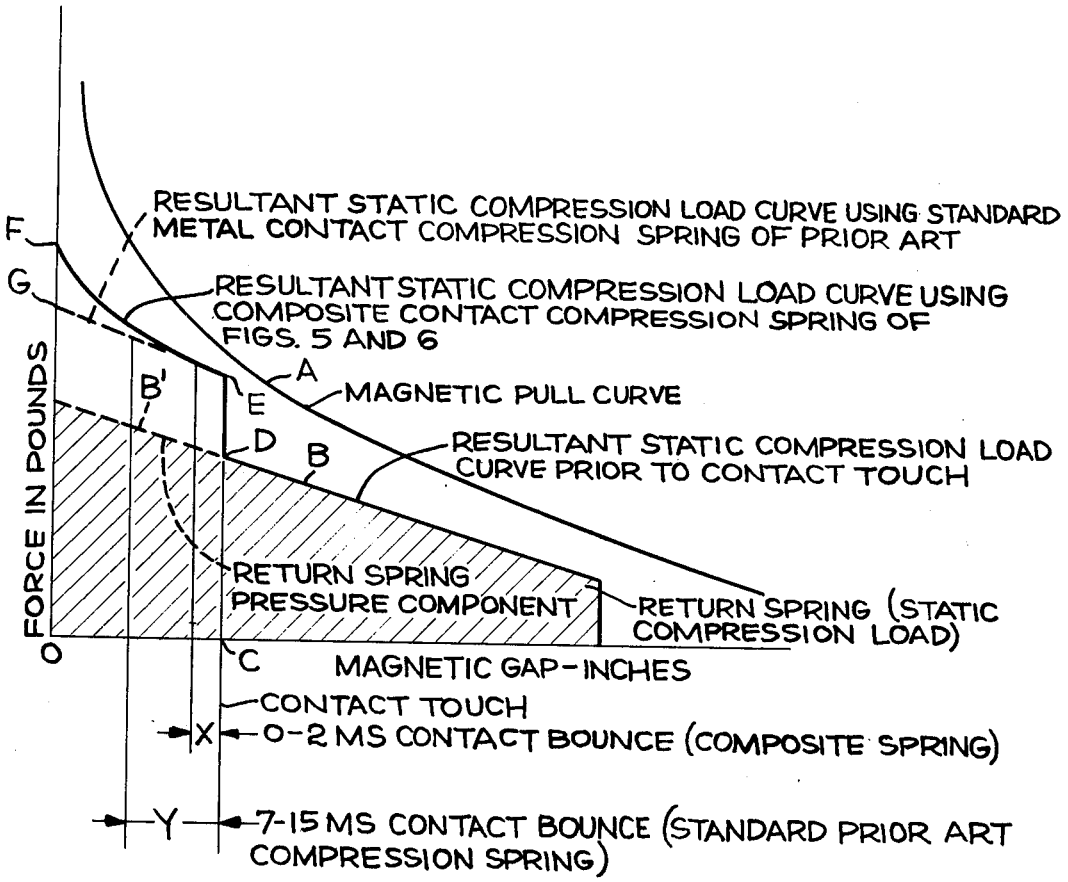
FIG. 15 is a graph showing the static load curve vs. magnetic pull curve in an electromagnetically operated switch device for a standard contact compression spring as compared to the composite spring of the present invention.

Refer now to FIG. 15 which shows the static compression load curve of a standard metal compression spring conventionally used in the prior art for maintaining the movable contact 74 against the fixed contact 45, as compared to the static compression load curve of a composite spring using energy absorbing material in accordance with the invention, together with their relationship to the force exerted by the return or restoring spring 34 (FIGS. 1–4, inclusive), and further showing their relationship to the conventional magnetic pull curve which is the pull of the magnetic operating device such as the magnetic core member 20 of FIG. 1–4 tending to pull the armature member 46 into magnetically sealed position.

The curves of FIG. 15 are plotted with force in pounds as an ordinate vs. magnetic air gap between the armature member 46 and the pole face 30 of magnetic core member 20 as the abscissa.

It will be noted upon examination of FIG. 15 that the magnetic pull curve A exerted by the magnetic core member 20 upon the armature member 46 is of curvilinear or exponential shape, and shows that the magnitude of the force exerted by the magnetic core member 20 upon armature 46 increases at a very rapid rate as the air gap between the armature and pole face 30 of magnetic core member 20 approaches zero.

One of the forces acting against the magnetic pull exerted on armature 46 by magnetic core 20 is the return or restoring spring 34 which tends to move the armature to an open position. The force exerted by the return or restoring spring 34 is indicated by the line B and dotted line B′ which is an extension of line B and which, as can be seen in FIG. 15, together show a linear relationship between the force exerted by restoring spring 34 and the air gap between the armature and the magnetic core throughout the entire range of movement of armature 46.

Until contact touch occurs between the movable contact 74 and the fixed contact 45 (FIGS. 1–4, inclusive) during the movement of armature 46 toward magnetically sealed position (i.e., zero air gap), the only force acting against the movement of the armature 46 is the force of restoring spring 34 as indicated by line B, which represents the resultant static pressure load curve up to the moment when contact touch occurs. However, when touch occurs between movable contact 74 and fixed contact 45 at point C on the abscissa axis, the spring which is used to apply contact pressure, such as applicant's composite spring 92, is additionally compressed and there is a steep rise in the resultant static pressure load curve as indicated by the steeply rising vertical line DE which coincides with the moment of contact touch at abscissa point C. The added force of the contact pressure applying spring such as applicant's composite spring 92 thus causes a steep rise in the resultant static pressure load curve which adds to the force against which the magnetic core 20 must work in pulling the armature 46 toward sealed position. It might be mentioned at this point that this same rise along the line DE would also occur at the moment of contact touch, at abscissa point C, using a conventional metal spring of the prior art which does not employ applicant's energy absorbing material.

With movable contact 74 now having touched fixed stationary contact 45, armature 46 continues its additional increment of travel toward completely magnetically sealed position as previously explained (i.e., moving toward zero air gap), this additional increment of movement of armature 46 causing an additional increment of pressure in applicant's composite spring 92 which follows the curvilinear and exponential curve line EF.

It must be remembered that the curvilinear and exponential line EF represents the curve of the resultant static pressure load acting against movement of armature 46 toward magnetically sealed position during the increment of movement of the armature after the contact touch point C on the abscissa axis has been passed, this resultant static pressure load EF being the summation of the compression load exerted by (1) the contact pressure applying composite spring 92, and (2) by the return or restoring spring 34 as indicated by projection B′ of line B lying in the region of incremental movement of the armature after contact touch has occurred. Armature 46 must move against the force represented by resultant static load curve portion EF in moving to its finally sealed-in position against magnetic core 20 in which the air gap between the armature 46 and core 20 is zero.

In contrast to the curvilinear and exponential curve line EF which represents the resultant static compression load curve when applicant's composite spring 92 is used, the linear line EG (FIG. 15) represents the resultant static compression load acting against the movement of the armature toward sealed position when a conventional metal wire spring of the prior art is used in place of the composite spring 92 of applicant's invention for maintaining pressure between the movable contact 74 and the fixed contact 45. The resultant static load line EG is the summation of the static load force exerted by the restoring spring 34 (as indicated by line B′) plus the compression force exerted by the conventional metal wire compression spring which was used in the prior art in place of the composite spring 92 of applicant's invention for applying contact pressure, and against which the magnetic pull curve A must work in pulling armature 46 to its finally magnetically sealed-in position.

Superimposed upon the static pressure load curves of FIG. 15 are the time relationships during which contact bounce occurs using applicant's composite spring device 92 with its energy absorbing material as compared to the duration of the bouncing interval experienced using the conventional metal wire spring instead of applicant's composite spring 92 for maintaining contact pressure between movable contact 74 and fixed stationary contact 45. It must be remembered that while the curves of FIG. 15 are based on static pressure loading conditions, the bouncing action of the contacts occurs during the dynamic operation of switch 10 with the movable contact 74 being in motion relative to stationary contact 45.

It will be seen that using applicant's composite spring 92 with its energy absorbing material, and, as previously explained, experience has shown that movable contact 74 will bounce relative to fixed contact 45 for the interval identified by the letter "X" which represents a bounce period duration of zero to 2 milliseconds. In contrast, and also superimposed on the curves of FIG. 15, it can be seen that using the standard metal wire spring of the prior art for maintaining contact pressure between movable contact 74 and fixed contact 45, movable contact 74 will bounce relative to fixed contact 45 during the interval indicated at "Y" which represents a bounce period of approximately 7 to 15 milliseconds.

It will be noted that the curvilinear resultant static pressure load curve EF intersects the force axis (the ordinate axis) at zero air gap at a point higher on the ordinate or force axis than the point at which resultant static pressure load curve EG intersects the ordinate or force axis. (Curve EF represents the resultant pressure or force condition with applicant's composite spring 92 while curve EG represents the resultant pressure or force condition using the conventional contact pressure applying metal spring of the prior art.) The higher point of intersection of curve EF with the ordinate or force axis than the point of intersection of curve EG with the ordinate or force axis can be interpreted as follows: Assuming that two identical metal springs are used, and both are preloaded to the same degree as by cap 100 and cotter pin 102 (FIG. 2), but one of the identical metal springs is embedded in an energy absorbing means having substantial elastic hysteresis as hereinbefore described to form what has hereinbefore been referred to as a composite spring, and the other identical metal spring is not embedded in an energy absorbing means but is merely a metal compression spring in accordance with the prior art, then when the contacts 74 and 45 (FIGS. 1–4, inclusive) are engaged and armature 46 is magnetically sealed in at zero air gap, composite spring such as spring 92 as just defined, will exert a greater pressure tending to hold movable contact 74 against stationary contact 45 than will the conventional metal compression spring which is not embedded in the energy absorbing material.

From an examination of the curves of FIG. 15, it will be noted that throughout the entire range of movement of armature 46 from its fully open position (maximum air gap) to its fully closed or magnetically sealed-in position (zero air gap), the force in pounds of the magnetic pull curve A exerted by the magnetic circuit including magnetic core member 20 is always greater in magnitude than the resultant static pressure load which must be overcome by the magnetic pull curve A in pulling armature 46 into its magnetically "sealed-in" position at zero air gap.

In explaining and describing the curves of FIG. 15, reference has been made to the various structural elements of the embodiment of FIGS. 1–4, inclusive, of applicant's invention. However, it will be understood that the same principles apply to the other illustrated embodiment shown in FIGS. 7–11, inclusive, of the drawings.

While both embodiments of the invention have been described using electromagnetic operating means for causing the movement of the movable contact into engagement with the fixed contact, it will be understood that applicant's invention applies equally well to a construction in which the movable contact is moved into engagement with the fixed contact by a mechanical means which is of noneelectrical or of nonelectromagnetic nature.

While the energy absorbing material has been described as being "molded" about the wire spring to form the composite spring, this term is not intended to be restrictive and is intended to include any other equivalent method which might be used to associate the energy absorbing material with the wire spring, or to embed the wire spring in the energy absorbing means, including the steps of casting, pouring, etc.

It might also be mentioned that an important advantage of the significant reduction in the amplitude, amount, and duration of arcing achieved by the use with the electrical contacts of the composite spring having the energy absorbing material as previously explained in some detail is that there is achieved thereby a significant reduction in the electric "noise," — that is, electrical radiation — produced by arcing between the movable and fixed contacts. This significant reduction in electrical "noise" or electrical radiation caused by arcing is particularly important and significant when the switch device of the present invention is associated with or in close proximity to solid state circuitry, transistorized circuitry, integrated circuits or the like, all of which are very sensitive to stray electrical fields such as those produced by the electric "noise" or electrical radiation inherent in any arcing. Thus, the use of the energy absorbing composite spring of the invention as hereinbefore described, makes electrical contacts and switches so equipped much more compatible with such solid state devices as just mentioned, and greatly reduces the chances of malfunctioning of the solid state circuitry which might be caused by arcing of the prior art switch devices not equipped with the energy absorbing means hereinbefore described.

From the foregoing detailed description of the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. An electric switch comprising a stationary contact and a movable contact engageable with said stationary contact to complete an electrical circuit through said contacts, a switch operating member, pressure applying means operatively associated with said switch operating member and with said movable contact and so positioned as to transmit force between said switch operating member and said movable contact, said pressure applying means being engageable with said movable contact and being operated by said switch operating member to move said movable contact into engagement with said stationary contact and to hold said movable contact in pressurized engagement with said stationary contact, said pressure applying means comprising an energy absorbing means having substantial elastic hysteresis which minimizes bounce of said movable contact relative to said stationary contact upon closure of said contacts, said pressure applying means additionally comprising resilient spring means having low elastic hysteresis and structurally interrelated with said energy absorbing means to form a composite spring, said energy absorbing means and said resilient spring means acting in aiding relation to each other and being deformed simultaneously with each other by movement of said switch operating member to hold said movable contact in pressurized engagement with said stationary contact.

2. An electric switch as defined in claim 1 in which said energy absorbing means is selected from the group comprising the following: rubber, rubber-like plastics, neoprene rubber, latex foam rubbers, sponge and cellular rubber, synthetic rubber, butyl rubber, urethane foam, and closed cell polyvinyl chloride.

3. An electric switch as defined in claim 1 in which the loading force versus deflection characteristic of said composite spring is curvilinear, with the height of said composite spring varying in accordance with an inverse curvilinear characteristic with the magnitude of the loading force applied to said composite spring.

4. An electric switch as defined in claim 1 in which the impact loading force versus time characteristic of said composite spring is curvilinear, with the time required for said composite spring to deflect a predetermined distance varying in accordance with an inverse curvilinear characteristic with the magnitude of the impact loading force applied to said composite spring.

5. An electric switch as defined in claim 1 in which said pressure applying means is preloaded to a predetermined force.

6. An electric switch as defined in claim 1 in which said energy absorbing means is an elastomeric material.

7. An electric switch as defined in claim 1 in which said energy absorbing means is silicone rubber.

8. An electric switch as defined in claim 1 in which said spring means is embedded in said energy absorbing means.

9. An electric switch comprising an elctromagnetic operating means, an armature member normally biased out of engagement with said electromagnetic operating means but mounted for movement into magnetic engagement with said electromagnetic operating means upon electrical energization of said operating means, a contact carrier arm pivotally mounted on said armature member, a movable contact mounted on said contact carrier arm and movable with said contact carrier arm, a stationary contact mounted in the path of movement of said movable contact to complete an electrical circuit through said movable and said stationary contacts upon engagement of said contacts with each other, pressure applying means operatively associated with said armature and with said contact carrier arm and so positioned as to transmit force between said armature and said contact carrier arm, said pressure applying means being engageable with said contact carrier arm and being actuated by said armature member to actuate said movable contact into engagement with said stationary contact and to hold said movable contact in pressurized engagement with said stationary contact, said movable contact engaging said stationary contact before said armature member has completed its movement into magnetically sealed engagement with said electromagnetic operating means, and means connecting said armature member to said pressure applying means whereby the increment of movement of said armature member into magnetically sealed engagement with said electromagnetic operating means after said movable and said stationary contacts have engaged each other is effective to apply compressive force to said pressure applying means to thereby increase the pressure of said movable contact against said stationary contact, said pressure applying means comprising an energy absorbing means having substantial elastic hysteresis which minimizes bounce of said movable contact relative to said stationary contact upon closure of said contacts, said pressure applying means additionally comprising resilient spring means having low elastic hysteresis and structurally interrelated with said energy absorbing means to form a composite spring, said energy absorbing means and said resilient spring means acting in aiding relation to each other to hold said movable contact in pressurized engagement with said stationary contact, said energy absorbing means and said resilient spring means being deformed simultaneously with each other during movement of said armature member into magnetic engagement with said electromagnetic operating means.

10. An electric switch as defined in claim 9 in which said energy absorbing means is an elastomeric material.

11. An electric switch as defined in claim 9 in which said energy absorbing means is silicone rubber.

12. An electric switch as defined in claim 9 in which said energy absorbing means is selected from the group comprising the following: rubber, rubber-like plastics, neoprene rubber, latex foam rubbers, sponge and cellular rubber, synthetic rubber, butyl rubber, urethene foam, and closed cell polyvinyl chloride.

13. An electric switch as defined in claim 9 in which said pressure applying means is preloaded to a predetermined force.

14. An electric switch comprising a stationary contact and a movable contact engageable with said stationary contact to complete an electrical circuit through said contacts, an electromagnetic solenoid, a plunger member of magnetic material axially movable in an axial passage of said solenoid, a pressure applying means operatively associated with said plunger member and with said movable contact and so positioned as to transmit force between said plunger member and said movable contact, said pressure applying means being engageable with said movable contact and being operated by said plunger member to move said movable contact into engagement with said stationary contact and to hold said movable contact in pressurized engagement with said stationary contact, said pressure applying means being preloaded to a predetermined force, said movable contact engaging said stationary contact before said magnetic plunger has completed its movement in said axial passage of said solenoid, and means operatively relating said plunger to said pressure applying means whereby the increment of movement of said plunger into said solenoid after said movable and said stationary contacts have engaged each other is effective to apply compressive force to said pressure applying means to thereby increase the pressure of said movable contact against said stationary contact, said pressure applying means comprising an energy absorbing means having substantial elastic hysteresis which minimizes bounce of said movable contact relative to said stationary contact upon closure of said contacts, said pressure applying means additionally comprising resilient spring means having low elastic hysteresis and structurally interrelated with said energy absorbing means to form a composite spring, said energy absorbing means and said resilient spring means acting in aiding relation to each other and being deformed simultaneously with each other to hold said movable contact in pressurized engagement with said stationary contact.

15. An electric switch as defined in claim 14 in which said energy absorbing means is an elastomeric material.

16. An electric switch as defined in claim 14 in which said energy absorbing means is silicone rubber.

* * * * *